US007281992B2

(12) United States Patent
Tseng

(10) Patent No.: US 7,281,992 B2
(45) Date of Patent: Oct. 16, 2007

(54) GOLF CLUB HEAD AND METHOD OF FABRICATING THE SAME

(75) Inventor: Wen-Cheng Tseng, 14F, No. 66, Kuanghua 2 Rd., Chienchen Dist., Kaohsiung (TW)

(73) Assignees: Super Way Technology Co., Ltd., Kaohsiung (TW); Kung-Wen Lee, Kaohsiung (TW); Wen-Cheng Tseng, Kaohsiung (TW)

( * ) Notice: Subject to any disclaimer, the term of this patent is extended or adjusted under 35 U.S.C. 154(b) by 200 days.

(21) Appl. No.: 10/992,728

(22) Filed: Nov. 22, 2004

(65) Prior Publication Data

US 2005/0187033 A1 Aug. 25, 2005

(30) Foreign Application Priority Data

Feb. 23, 2004 (TW) ..... 93104406 A

(51) Int. Cl.
*A63B 54/04* (2006.01)

(52) U.S. Cl. ..... 473/345

(58) Field of Classification Search ..... 473/324–350
See application file for complete search history.

(56) References Cited

U.S. PATENT DOCUMENTS 4,214,754 A * 7/1980 Zebelean ..... 473/346

FOREIGN PATENT DOCUMENTS

JP 07284546 A * 10/1995

* cited by examiner

*Primary Examiner*—Eugene Kim
*Assistant Examiner*—Alvin A Hunter
(74) *Attorney, Agent, or Firm*—Rosenberg, Klein & Lee

(57) ABSTRACT

A method for manufacturing a golf club head includes forming a hollow body having a crown on top of the hollow body, the crown having a rim formed on an outer periphery of the crown, a recessed area encircled by the rim, ribs formed on an inner face of the recessed area and multiple elongated bosses formed on a top face of the recessed area, removing the elongated bosses and polishing the top face of the recesses area to complete the process.

1 Claim, 6 Drawing Sheets

GOLF CLUB HEAD AND METHOD OF FABRICATING THE SAME

BACKGROUND OF THE INVENTION

1. Field of the Invention

The present invention relates to a golf club head and a method of fabricating the same, and more particularly to a golf club head that has a crown with a working face composed of a recessed area and bosses formed on an inner face of the recessed area so that center of gravity is able to be lowered due to addition of weight to the bottom portion of the golf club head to offset loss of weight in the crown.

2. Description of Related Art

Golf continues to attract new enthusiasts all over the world at both amateur and professional levels, and even in the non-playing public who derive great pleasure from watching the top players strike balls with phenomenal accuracy. The intense competitive nature of this sport spurs on manufacturers to find the Holy Grail of golf clubs—the perfect club with which a player can finally defeat all rivals.

Generally speaking, a golfer hits balls with a swing speed from 30 to 50 meters per second (m/s) with an impact duration of about 0.0045 second. To consistently ensure powerfully and successfully striking a ball, all conditions of the head must be stable. The club head has a face with a faceplate designed to make direct contact with the ball so increased stiffness of the faceplate can help the golfer strike a ball powerfully. Some methods for increasing the stiffness of the faceplate have been developed. One of them is to add ribs in the head to bear the force of impact when the head strikes the ball.

With reference to FIG. 7, a golf club head (20) in accordance with the prior art includes a hollow body, a crown on top of the hollow body and a shank. The minimum thickness of a club head wall using the most advanced technology is 0.9 mm. If the thickness is less than 0.9 mm, the club head is not able to be cast successfully due to inevitable inaccuracies in the casting process. Therefore, means such as adopting laser welding technology to weld the side wall of the club head to the crown and using acid to etch a portion of the thickness of the crown is taken into consideration when the club head is manufactured. Although the objective to reduce the side wall thickness is achieved, the cost of such a club head is so high that it is not affordable by average people.

To overcome the shortcomings, the present invention provides a method for fabricating a golf club head to obviate the aforementioned problems.

SUMMARY OF THE INVENTION

The primary objective of the present invention is to provide a method for fabricating a golf club head and the structure thereof. The method is able to reduce thickness of a golf club head side wall such that weight loss due to the removal of the side wall thickness is able to be balanced by designing-in extra weight to the bottom side or the rear side of the golf club head to achieve the purpose of low center of gravity, high torque endurance and improved shock absorbing capability.

The method in accordance with the present invention includes the following steps:

forming a hollow golf club head with a crown, wherein the crown has a rim, a working area defined in a face encircled by the rim and the crown is composed of multiple elongated bosses formed on a face of the working area;

removing the elongated bosses; and polishing the face of the working area.

The structure of the golf club head of the present invention has an hollow body with a crown. The crown is composed of a rim and a working area. The working area has multiple ribs formed on an inner face of the working area to reinforce strength of the working area.

Other objectives, advantages and novel features of the invention will become more apparent from the following detailed description when taken in conjunction with the accompanying drawings.

DETAILED DESCRIPTION OF PREFERRED EMBODIMENT

Figure 1:
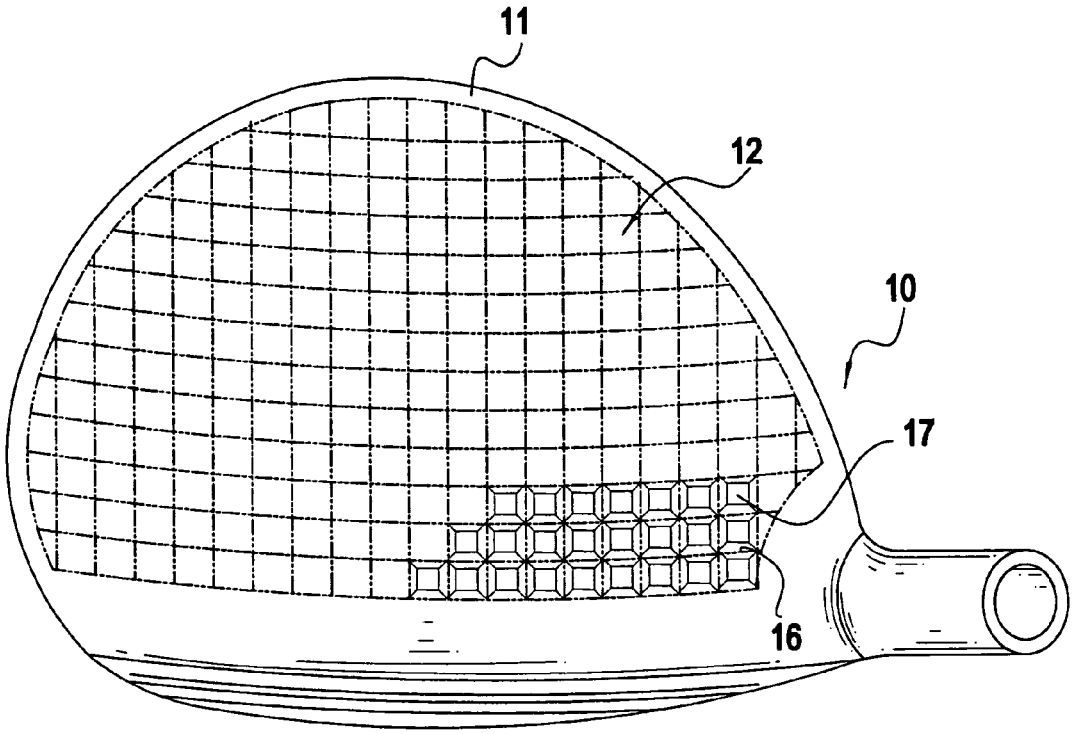
FIG. 1 is a schematic top plan view of the golf club head of the present invention.
Figure 2:
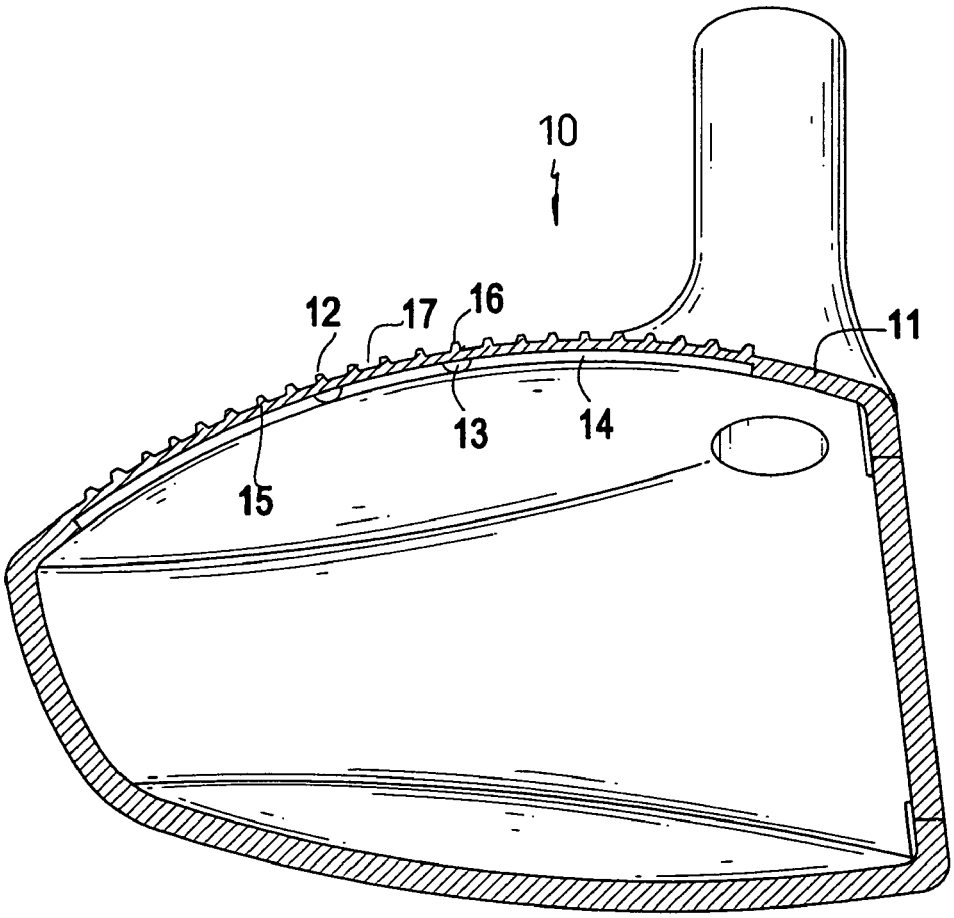
FIG. 2 is a cross sectional view showing the structure of the golf club head shown in FIG. 1.

With reference to FIGS. 1 and 2, a golf club head (10) in accordance with the present invention includes a hollow body and a crown (15) on top of the hollow body. The crown (15) is composed of a rim (11) and a working area (12). Further, the working area (12) is divided into a recessed area (17) and multiple elongated bosses (16) formed on an outer face of the recessed area (17). On an inner face of the recessed area (17), a concavity (14) is defined and multiple ribs (13) are formed thereon to reinforce strength of the working area.

Figure 3:
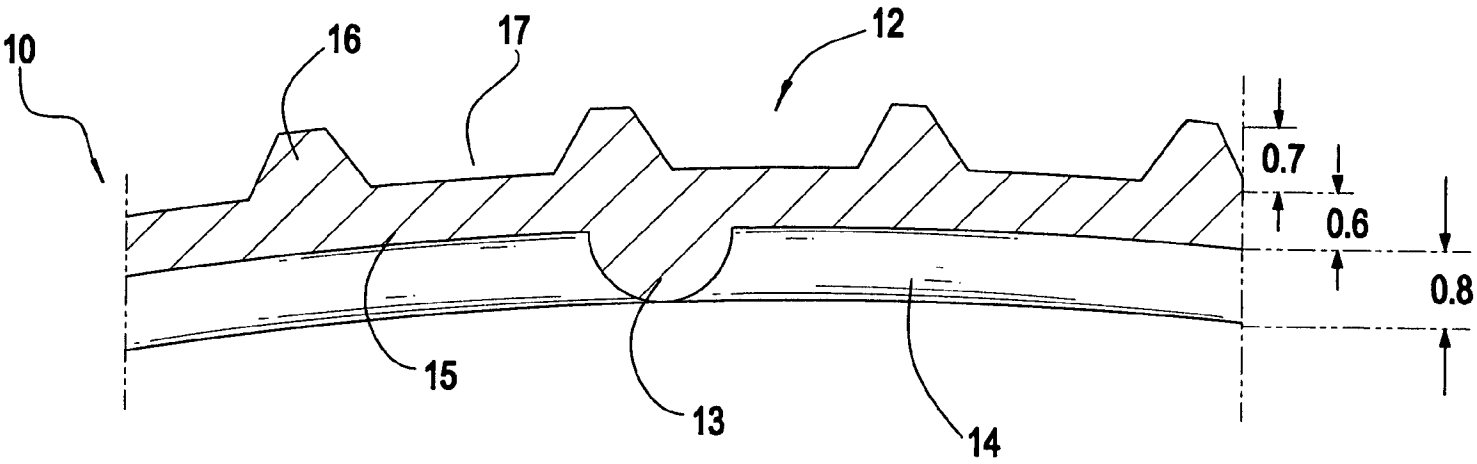
FIG. 3 is a schematic cross sectional view showing the structure of the side face of the crown.
Figure 4:
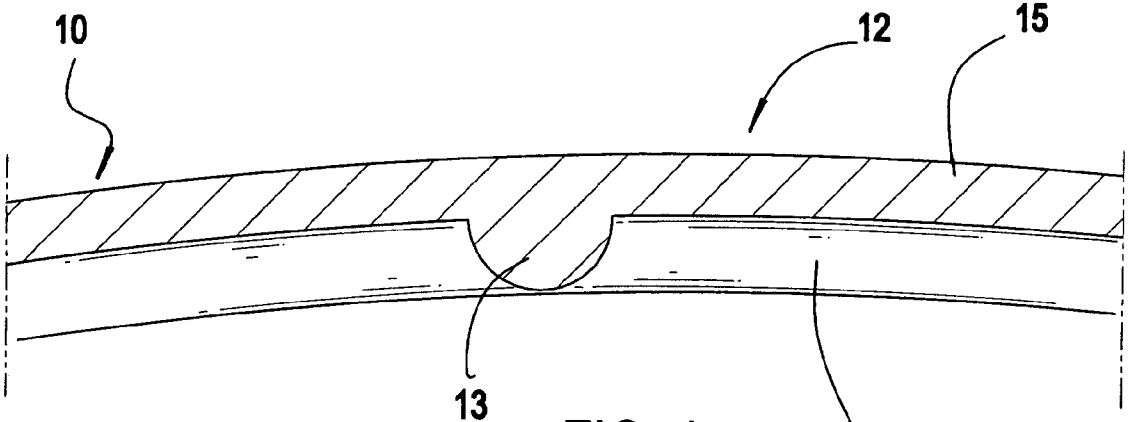
FIG. 4 is a schematic cross sectional view showing the structure of the side face of the crown after polishing the side face of the crown.
Figure 5:
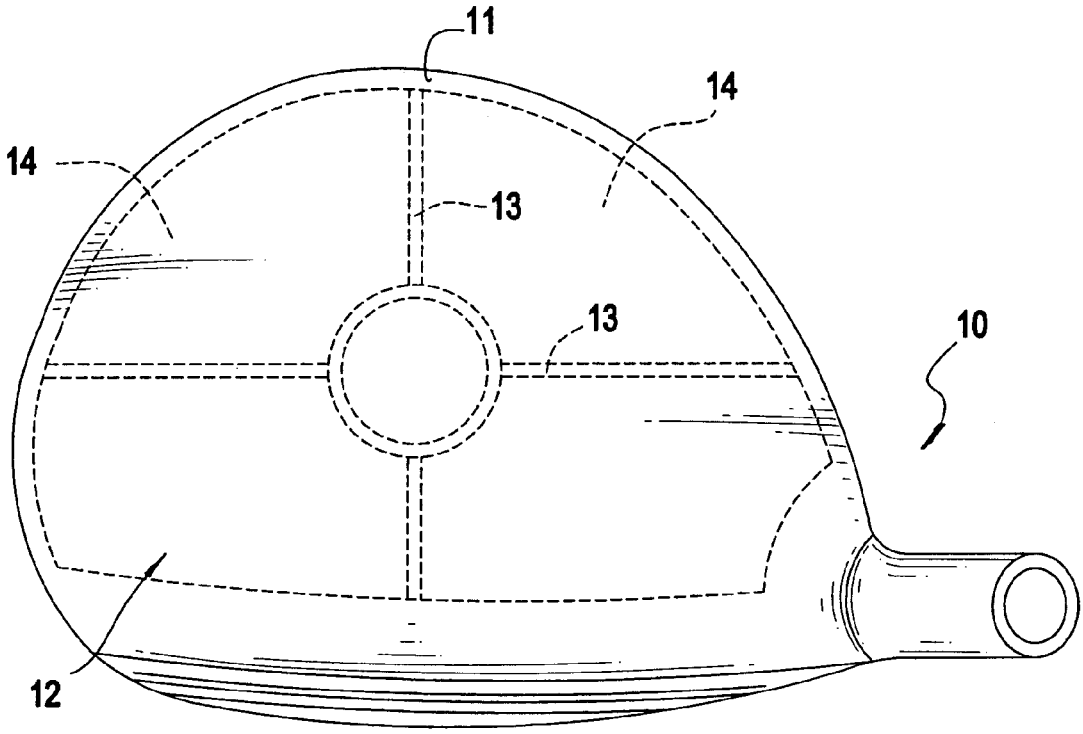
FIG. 5 is a schematic top plan view showing that ribs are formed on an inner face of the working area.

With reference to FIGS. 3 and 4, it is noted that the overall thickness of the crown (15) is the combination of the thickness of the recessed area (17) and the thickness of the elongated bosses (16). From the depiction of the accompanied drawing of FIG. 3, it is noted that the thickness of the recessed area (17) is 0.6 mm and the thickness of each of the elongated bosses (16) is 1.3 mm. There is a thickness difference, i.e. 0.7 mm between the elongated bosses (16) and the recessed area (17).

As introduced earlier, even using the most advanced technology, the thickness of the side wall of the golf club head has to be equal or larger than 0.9 mm. According to this concept, the thickness of the side wall of the crown (15) is considered to be 1.3 mm, which complies with the aforementioned limitation. However, to lessen the thickness of the side wall of the crown (15) so as to accomplish the objective of lowering the center of gravity by relocating the weight removed from the side wall of the crown (15), the elongated bosses (16) are removed afterwards. Thus the overall thickness of the side wall of the crown (15) is now 0.6 mm. Even though the elongated bosses (16) are removed, with the provision of the ribs (13) on the inner face of the crown (15), the surface strength of the crown (15) is maintained. Therefore, the rim (11) is 0.9 mm in thickness, the rib (13) is 0.8 mm in thickness and a thickness between the face of the concavity and the top face of the crown is 0.6 mm. Finally, the manufacturer polishes the surface of the crown (15) to complete the golf club head of the present invention.

As a consequence of removal of the elongated bosses (16), the manufacturer is able design in the equivalent of the removed weight to the bottom side of the golf club head to lower the center of gravity or the manufacturer is able to use the weight difference to add in an impact cushion device to the golf club head to increase the impact resistance.

Figure 6:
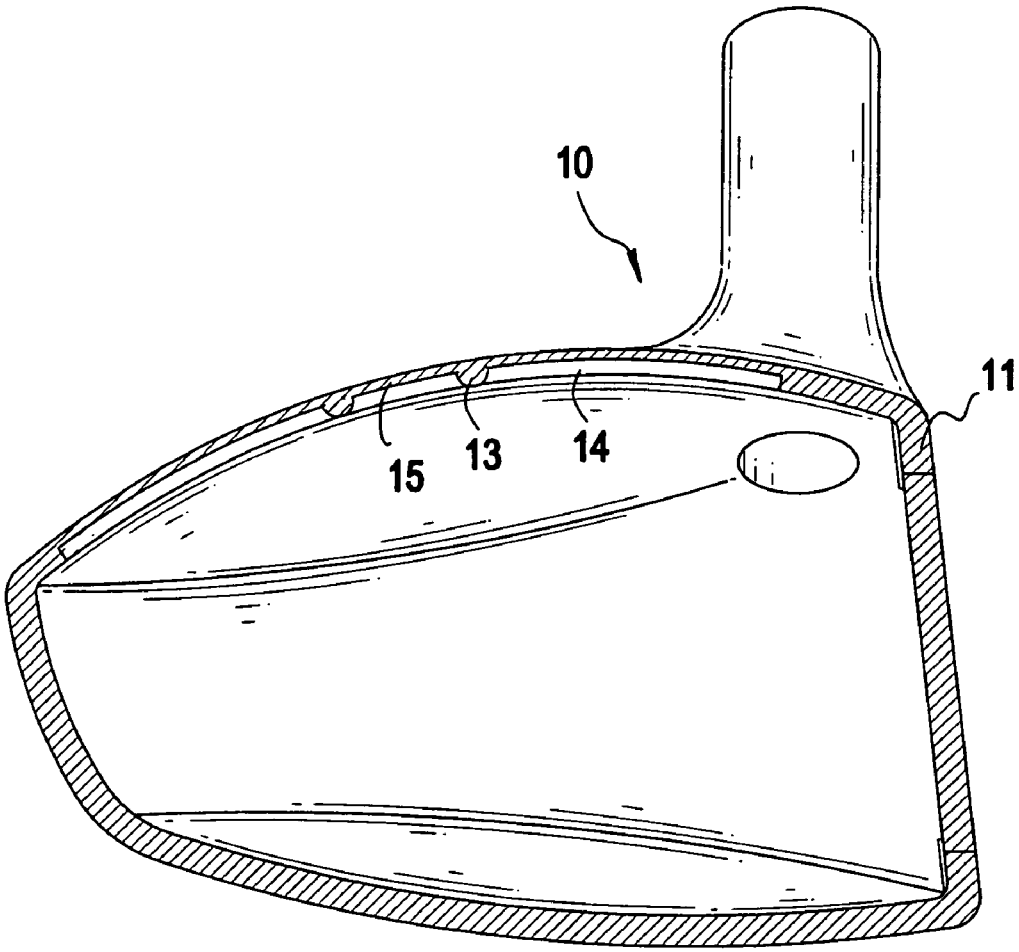
FIG. 6 is a schematic cross sectional view showing the overall structure of the golf club head of the present invention.
Figure 7:
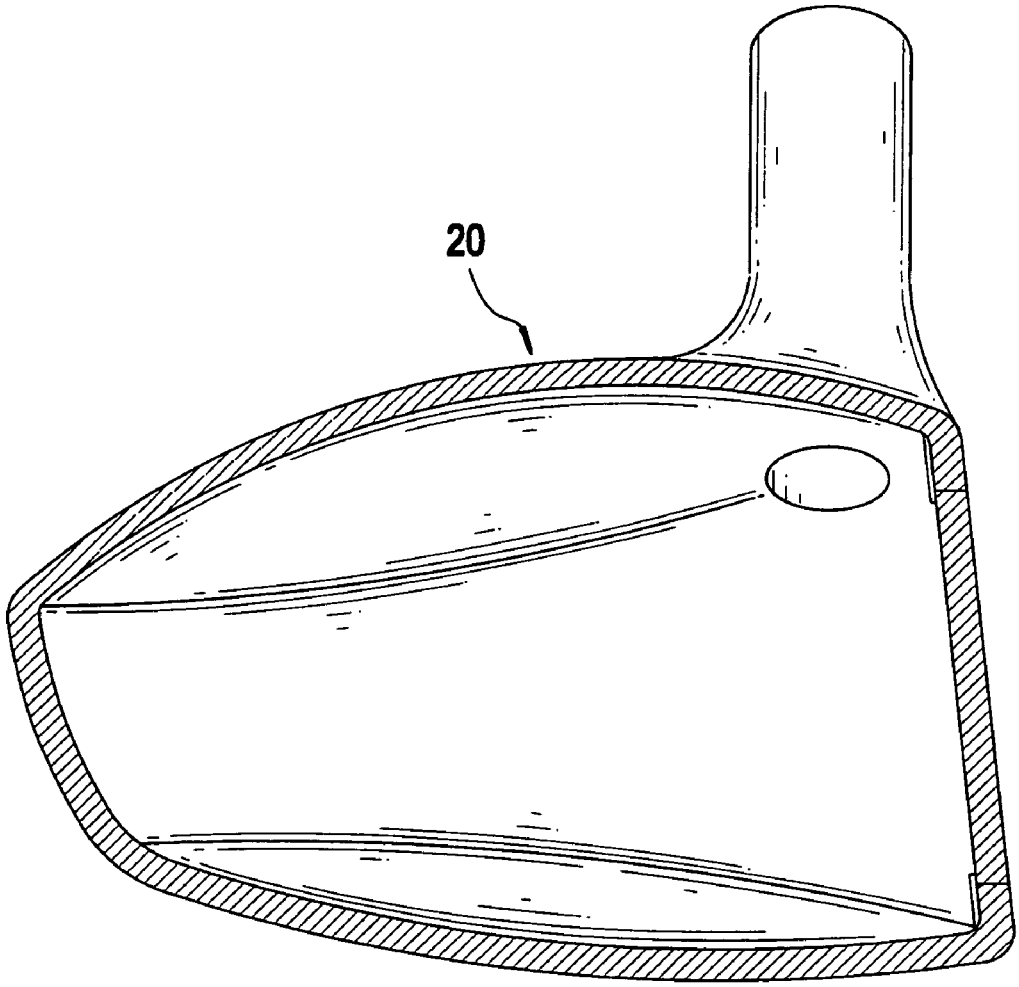
FIG. 7 PRIOR ART
FIG. 7 is a cross sectional view of a conventional golf club head.

With reference to FIG. 6, it is noted that even though there are ribs (13) formed on the inner face of the crown (15), the addition of the ribs (13) does not offset the weight loss from the removal of the elongated bosses (16). However, after the additional weight to the bottom of the golf club head, the overall weight of the golf club head is not changed. That is, without changing the overall weight of the golf club head, the center of gravity of the golf club head is lowered or the impact resistance is emphasized.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A method for manufacturing a golf club head comprising the steps of:

casting a hollow body having a crown on top of the hollow body, the crown having a rim formed on an outer periphery of the crown, a central area encircled by the rim, the central area being recessed on an inner face thereof with respect to the rim, a plurality of ribs formed on the inner face of the central area, and a multiplicity of elongated raised bosses formed on a top face of the central area to define an array of cells on the central area;

removing the multiplicity of elongated bosses to form a continuous upper surface of the crown and to form the central area with a wall thickness less than a wall thickness of the rim; and polishing the top face of the central area to complete the process.

* * * * *